US005451467A

United States Patent [19]

Lock

[11] Patent Number: 5,451,467

[45] Date of Patent: Sep. 19, 1995

[54] LAMINATED ABSORBENT PRODUCT

[76] Inventor: Peter M. Lock, 2209 Glenalden East, Germantown, Memphis, Tenn. 38139

[21] Appl. No.: 904,187

[22] Filed: Jun. 25, 1992

[30] Foreign Application Priority Data

Jun. 26, 1991 [GB] United Kingdom ..... 9113861

[51] Int. Cl.[6] ..... B32B 27/06; A61L 15/00

[52] U.S. Cl. ..... 428/507; 428/508; 428/533; 428/913; 424/443; 424/449; 424/445; 602/41; 602/52; 602/58; 604/304

[58] Field of Search ..... 428/533, 507, 508, 913; 424/443, 449, 445; 602/41, 52, 58; 604/304

[56] References Cited

U.S. PATENT DOCUMENTS

| | | | |
|---|---|---|---|
| 2,810,426 | 10/1957 | Till et al. | 154/27 |
| 2,988,469 | 6/1961 | Watson | 154/101 |
| 3,275,496 | 9/1966 | Sponsel | 162/101 |
| 3,813,466 | 5/1974 | Anderson | 424/445 |
| 4,646,730 | 3/1987 | Schonfeld | 604/368 |
| 4,702,947 | 10/1987 | Pall et al. | 428/36 |
| 5,063,063 | 11/1991 | Miller | 424/445 |

FOREIGN PATENT DOCUMENTS

| | | |
|---|---|---|
| 1259084 | 1/1972 | European Pat. Off. . |
| 1259085 | 1/1972 | European Pat. Off. . |
| 0007149 | 1/1980 | European Pat. Off. . |
| 2031719 | 11/1970 | France . |
| 2031720 | 11/1970 | France . |
| 2416535 | 8/1979 | France . |
| 827641 | 2/1960 | United Kingdom . |
| 2015253 | 9/1979 | United Kingdom . |
| WO81/03265 | 11/1981 | United Kingdom . |

*Primary Examiner*—P. C. Sluby
*Attorney, Agent, or Firm*—Edward H. Renner

[57] ABSTRACT

The present invention relates to thermoplastic membranes which are selectively permeable to water or water vapor and which can be simply produced by the lamination of a thermoplastic sheet onto an absorbent material at or around the glass transition temperature of the thermoplastic.

6 Claims, No Drawings

LAMINATED ABSORBENT PRODUCT

BACKGROUND OF THE INVENTION

The present invention relates to porous membranes for coating absorptive materials and processes for their production.

There is considerable demand for articles which are absorbent, examples-of such articles being sanitary pads, nappies, plasters and wound dressings in general.

Many materials are suitable for use in such absorbent articles, and these generally comprise an interlinked, or cross-linked, disperse layer of a fibrous substance, such as cellulose, which has been so treated as to be able to absorb liquids. For example, EP-A-252650 discloses a material made of stiffened curled cellulosic fibers, while EP-A-7134 discloses a fibrous cellulosic sheet, the fibers being bibulous cellulosic fibers and/or sodium carboxymethyl cellulose fibers. These are cross-linked by wetting and applying heat and pressure.

For some applications, it is suitable to apply the material directly to the area where it is required to absorb liquid, but this, as a rule, is undesirable for the treatment of wounds, as the fibers may irritate, or penetrate the wound, or both. In addition, exposed fibrous matrices, especially those containing wound exudates, can provide an ideal environment for the reproduction of bacteria.

To overcome such problems, articles comprising such materials generally further comprise protective membranes. In such instances, it is common to have an impervious membrane on the side of the material not intended for absorption, while a porous membrane is provided on the absorptive side. Well known examples of this type of application include nappies and sticking plasters.

Whilst it is relatively easy to provide a porous membrane to allow the cross passage of liquids, problems arise in preventing backflow of the liquids. In sticking plasters, for example, the porous membrane characteristically comprises an impervious plastics film with many small perforations.

SUMMARY OF THE INVENTION

It is an object of the invention to provide membranes for use in the above applications which overcome the problem of backflow of absorbed liquids. It is also an object to provide a process for the preparation of such membranes.

It is a further object of the invention to provide air and vapor permeable membranes but which are not also water permeable. It is a further object to provide processes for the preparation of such membranes. It is a yet further object of the invention to provide articles as hereinbefore described comprising one or both of the above types of membrane.

It has now been discovered that it is possible to provide both of the above described types of membrane by the lamination of a thermoplastic sheet onto an absorbent material at or around the glass transition temperature of the thermoplastic.

Thus, in a first aspect, the present invention provides a process for the provision of a porous membrane on an absorbent, fibrous material, comprising laminating a thermoplastic layer onto the surface of the material, characterized in that the thermoplastic is laminated onto the material at, or around, its glass transition temperature.

DETAILED DESCRIPTION OF THE INVENTION

In the present context, "glass transition temperature" is used to indicate that temperature, or range of temperatures, at which a thermoplastic begins to flow, and is distinct from the melting point of the thermoplastic. In particular, "at or around" is used to indicate that range of temperatures beginning with the glass transition point and ending at or below the melting point of the thermoplastic. Although the preferred lamination temperature is below the melting point of the thermoplastics, it will be appreciated that, under certain circumstances, it will be possible to laminate the thermoplastics at, or slightly above, the melting point of the thermoplastic, provided that the treatment is sufficiently rapid that the thermoplastic only flows for a very short period of time, so that the membrane does not disintegrate.

It will be appreciated that, for different thermoplastics, the range of temperatures at which the process can be carried out varies. For example, a preferred thermoplastic comprises a blend of hydroxypropyl cellulose and carboxymethyl cellulose, and the glass transition point of this blend is very close to its melting point and, for a substantially even (50/50) blend, the temperature at which the process can be carried out is effectively limited to about a temperature of 352° F. (178° C.). By way of contrast, if these two substituents are mixed further with polyethylene, again in an even amount, the lamination can be effected at anything between about 149° to about 177° C. Such a blend of the three thermoplastics is a particularly preferred embodiment of the present invention, and has particularly good moisture retention properties as described hereinbelow. Thinner laminates of this material are particularly useful in permitting unidirectional passage-of water toward the absorbent material, but not away from the absorbent material, while thicker laminates do not permit passage of water but do permit passage of vapor.

Thus, it will be appreciated that essentially any thermoplastic may be used, provided that it is laminated onto the absorbent material at its glass transition temperature.

As used herein, the term "thermoplastic" relates to those polymers, or blends of polymers, which are able to form a thin flexible film, such that they may be introduced to the surface of the absorbent material and conform to the surface thereof in a manufacturing process without cracking or snapping, and which melt at higher temperatures.

Accordingly, many materials are incorporated within the definition of "thermoplastic", and generally include such substances as polyhydroxymethyl methacrylate, polyurethane, polypropylene, polyethylene and such substances as substituted polysaccharides, where these fall within the definition of thermoplastic as provided above. In particular, preferred substituted polysaccharides include carboxymethyl cellulose and hydroxypropyl cellulose.

The membranes of the present invention may be of any desired thickness. However, it is necessary that the entire membrane be laminated onto the absorbent material under such circumstances, and in such a way that the entire thickness of the thermoplastic reaches the glass transition temperature. Accordingly, the thickness of the membrane is effectively limited in practice, as a general technique for laminating the membrane onto the absorbent material is to use at least one pair of rollers, the one which is intended to come into contact with the thermoplastic being heated. Thus, if the lamination takes an excessive amount of time owing to the thickness of the thermoplastic, it is quite likely that the surface of the thermoplastic will start to melt before the inner face of the thermoplastic has reached the necessary temperature.

The thickness of the thermoplastic membrane will also determine the properties of that membrane. Thicker membranes will not be water permeable, but will tend to be gas and vapor permeable, much along the lines of human skin. However, what is most surprising is that the thinner membranes formed by this process permit preferential passage of water, or other liquids, toward the absorbent material. In fact, this tends to be so marked, that the passage of water is effectively one-way, so that water can readily pass into the absorbent material, but cannot return. This is a very marked advantage of the present invention, and represents a preferred embodiment.

The thicknesses of the membranes which give rise to the above two type of embodiment cannot be absolutely defined, as they are dependent on the nature of the thermoplastic involved. Nevertheless, as a general guide, very low density thermoplastics have been found to provide good water permeable membranes. For example, low density polyethylene (LDPE) may have a density as low as 15 g $m^{-2}$, although densities up to around 25 g $m^{-2}$ will also suffice.

Densities of about 25 g $m^{-2}$ up to about 35 g $m^{-2}$ LDPE will tend to provide water impermeable, but gas and vapor permeable, membranes.

On its own, LDPE is not preferred, although it will provide membranes as required. A particularly preferred thermoplastic is polyhydroxymethyl methacrylate, although this tends to be somewhat expensive to manufacture.

What has been found to be most preferable, from a point of view of ease of manufacture and final properties, is a blend of a less hydrophilic thermoplastic with a more hydrophilic thermoplastic. Thus, a blend of LDPE and carboxymethyl cellulose (CMC) has been found to be particularly useful. It may be conjectured that the less hydrophilic thermoplastic forms a matrix supporting the more hydrophilic thermoplastic, such that exposure to water causes a rupture between the two, and that back pressure of the liquid presses the two back together, although this invention is not limited by such conjecture.

Where two or more different thermoplastics are employed to form the one membrane, then it is preferred to blend them before applying them to the absorbent material. In particular, it is preferred to roll sheets of the thermoplastics together at or around a mutual glass transition temperature to provide a single layer of a thermoplastic blend. For example, a blend of hydroxypropyl cellulose, carboxymethyl cellulose and low density polyethylene may be achieved at temperatures of between 149° to about 177° C. The same temperature may be used to laminate the film onto the absorbent material.

The temperatures involved in achieving the desired effects can, in practice, be affected by the conditions prevalent. Thus, it is preferred to carry out the process under conditions of about 6 to about 8% humidity, and preferably at about 75° F. (about 24° C.). In addition, it has been found that a suitable pressure, both for pressing together several sheets of thermoplastic, and for laminating the thermoplastic onto the absorbent material, is about 15 lbs $in^{-2}$ (about 100 kP).

When rollers are used to press the films together, the rates will vary according to the thickness of the film and the temperature of the rollers. In practice, the temperature of the rollers will tend to be slightly above the glass transition temperature of the plastics, but will not be too far above, in order to prevent the plastics melting. A differential of a few degrees is suitable.

Where a thin layer is being compressed before being laminated onto the absorbent material, this can be done at roller speeds (where both rollers are heated) of up to around 1 m $min^{-1}$ Where such a layer is being laminated onto the absorbent material, the rate will necessarily be slower, as only one heated roller will have an effect on the membrane, so that speeds will necessarily be reduced to, for example, around 0.25 m $min^{-1}$. For the thicker membranes these speeds will be reduced by about a factor of 4. All of these conditions should be taken into account when laminating a thicker membrane on one side of the absorbent material and a thinner membrane on the other side of the absorbent material, although it is possible in practice, and preferable, to laminate both layers onto the absorbent material at the same time.

It will be appreciated that only one membrane needs to be applied to the absorbent material, and that it may be of either variety as defined. However, it is generally preferable that two membranes be provided on any type of absorbent material, but it is not necessary that both membranes be both types of membrane as defined herein, or that more .than one of the membranes be a membrane of the invention. For example, in the case of a nappy, the water permeable membrane of the invention may be provided on the one side of the material, while a solid layer of plastic be provided on the other. Alternatively, instead of a solid layer of plastic, a woven material impregnated with a water impermeable substance may be provided, for example.

The types of absorbent material onto which the membranes of the invention may be laminated vary widely. The only restriction is essentially that a sufficiently continuous surface of the material can be generated such that lamination of the thermoplastic results in effectively continuous contact between the membrane and the absorbent material. It will be appreciated that this is not particularly limiting, although it may be difficult under some circumstances to provide a layer of absorbent material which is suitable for application of the thermoplastic membrane. Nevertheless, suitable substances include foamed plastics (with higher melting points than the thermoplastics of the invention), blotting paper or similar, cotton wool, materials comprising bibulous fibers, and cellulosic matrices, especially those cross-linked by CMC (supra).

It will be appreciated that the membranes of the present invention provides unique and advantageous products. Accordingly, there is provided, in an alternative aspect of the present invention, a layer of absorbent material having, on at least one side thereof, a plastic membrane, characterized in that the plastic is a thermoplastic and is essentially integral but gas and vapor permeable.

There is further provided such a product as defined, wherein the membrane permits passage of aqueous liquids preferentially towards the layer of absorbent material. There is still further provided such a product wherein the passage of aqueous liquid, such as water, is substantially blocked in the direction away from the absorbent material.

In a preferred embodiment, there is provided an absorbent material as defined, comprising a membrane as defined on either side, one of which membranes is not permeable to water, and the other of which permits passage of water substantially only in the direction of the absorbent material.

The above embodiment is particularly preferred, especially for use in wound dressings, for example. The bottom layer is constructed from the lighter weight films such that it permits wound exudate to enter the dressing but, as explained above, not to leave. The top layer is constructed from the thicker film, so as not to permit passage of water in either direction, but to allow the passage of vapour, so that the dressing can "breathe". Thus, this dressing effectively doubles as natural skin, promoting rapid healing. Furthermore, the pores in the lower layer are not of a sufficient size to permit passage of microorganisms, so that this type of dressing is also remarkably clean, and does not tend to become infected in use.

In addition, it is especially advantageous to construct the top layer of two, but preferably one thermoplastic, particularly hydroxypropyl cellulose, while the bottom layer advantageously comprises carboxymethyl cellulose, hydroxymethyl cellulose and polyethylene in equal proportions.

The accompanying Example is intended for illustration only and does not serve to limit the invention in any way.

EXAMPLE

WOUND DRESSING

Lamination of Porous Membranes

The outer membrane of the dressing will be gas and vapor permeable, but water resistant. In order to achieve this in the present case, the membrane is prepared prior to lamination onto the absorbent material, in this case a layer of cross-linked cellulose fibers as disclosed in EP-A-252650.

A triple laminate is prepared for the outer layer and comprises:

1. Low Density Polyethylene film (LDPE);
2. Polyhydroxypropyl cellulose film (KLUCEL—KL); and
3. Carboxymethyl cellulose film (Blanose—BL).

The specifications are:

LDPE—BOWATER, DUPONT 30 gm $m^{-2}$ film.
KL—AQUALON, HERCULES 25 gm $m^{-2}$ film.
BL—AQUALON, HERCULES 20 gm $m^{-2}$ film.

The films were laminated together at a temperature of 350° F. (177° C.) between heated, polytetrafluoroethylene coated rollers, at a pressure of 15 lb $in^{-2}$ (100 kP), at a rate of 0.5 m $min^{-1}$.

The inner membrane is a double, water permeable laminate consisting of:

1. LDPE—15-20 g $m^{-2}$ (Bowater, Dupont);
2. CMC film (BL)—15-20 g $m^{-2}$ (Aqualon);

Lamination is as before at a temperature of 300° F. (149° C.) between two heated, polytetrafluoroethylene rollers, at a pressure of 15 lb $in^{-2}$ (100 kP), at a rate of 1 m $min^{-1}$.

The outer membrane and inner membrane are then laminated onto the absorbent material, at 350° F. (177° C.) between two heated, polytetrafluoroethylene rollers, at a pressure of 15 lb $in^{-2}$ (100 kP), at a rate of 0.25 m $min^{-1}$ to form a sandwich.

The finished material is then passed through a heated roller cutter and is cut to the various shapes and sizes required for the product.

What is claimed is:

1. A laminated, absorbent product comprising a layer of absorbent material which is thermally fused with at least one layer of thermoplastic film, the thermoplastic film providing a barrier to the escape of fluids from the absorbent material, and wherein said thermal fusion of the thermoplastic film renders said film gas and vapor permeable.

2. The product of claim 1, wherein the thermoplastic film permits passage of aqueous liquids substantially only towards said absorbent material.

3. The product of claim 2, wherein said absorbent material has, on one side thereof, a thermoplastic film which is not permeable to water and, on the other side, has a thermoplastic film which permits passage of water substantially only in the direction of said absorbent material.

4. The product of claim 2, wherein said absorbent material has, on one side thereof, a first layer of thermoplastic film which is not permeable to water and, on the other side, has a second layer of thermoplastic film which permits passage of water substantially only in the direction of said absorbent material, said first layer consisting essentially of hydroxypropyl cellulose, and said second layer consisting essentially of a blend of carboxymethyl cellulose, hydroxymethyl cellulose and low density polyethylene in equal proportions.

5. A laminated, absorbent product comprising a layer of absorbent material which is heat laminated on one side with a first layer of thermoplastic film, the first layer of thermoplastic film consisting essentially of hydroxypropyl cellulose, the first layer of thermoplastic film providing a liquid barrier to the escape of fluids from the absorbent material and being vapor permeable to permit the escape of gas and vapor from the absorbent material, the laminated absorbent product having a second layer of thermoplastic film disposed on a second side of the layer of absorbent material, the second layer of thermoplastic film consisting essentially of blend of carboxymethyl cellulose, hydroxymethyl cellulose and low density polyethylene in substantially equal proportions, the second layer of thermoplastic film permitting substantial passage of water through the film and into the absorbent layer and providing a barrier to the passage of water from the absorbent layer.

6. The laminated, absorbent product of claim 5 wherein the first layer of thermoplastic film is rendered gas and vapor permeable by heat lamination with the absorbent layer.

* * * * *